US008422933B2

(12) United States Patent
Dufort et al.

(10) Patent No.: US 8,422,933 B2
(45) Date of Patent: Apr. 16, 2013

(54) CURVED PRE-FUSER TRANSPORT TO ENABLE LARGER SHEETS THROUGH A XEROGRAPHIC PRINT ENGINE

(75) Inventors: Ron E Dufort, Rochester, NY (US); Victoria Warner, Caledonia, NY (US); Alex Talevski, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 351 days.

(21) Appl. No.: 12/777,650

(22) Filed: May 11, 2010

(65) Prior Publication Data

US 2011/0280639 A1 Nov. 17, 2011

(51) Int. Cl.
*G03G 15/00* (2006.01)

(52) U.S. Cl.
USPC ..... 399/400; 399/397

(58) Field of Classification Search ..... 399/381, 399/388, 397, 400, 107
See application file for complete search history.

(56) References Cited

U.S. PATENT DOCUMENTS

| | | | | |
|---|---|---|---|---|
| 5,404,805 | A * | 4/1995 | Fujimoto et al. | 101/118 |
| 5,608,511 | A * | 3/1997 | Attridge | 399/398 |
| 2009/0003909 | A1 * | 1/2009 | Spence | 399/400 |

* cited by examiner

*Primary Examiner* — Judy Nguyen
*Assistant Examiner* — Blake A Tankersley
(74) *Attorney, Agent, or Firm* — Ronald E. Prass, Jr.; Prass LLP

(57) ABSTRACT

A media transport that will fit between a xerographic transfer station and a fuser station is provided by this invention. The purpose of this media transport is to increase the distance that media with an unfused image will travel from transfer to fusing stations thus permitting longer media to be used in the xerographic system without the risk of disturbing the unfused image. A vacuum is positioned internally of the transport that will provide a vacuum force to hold a media sheet to belts that are guided by the top surface of the media transport. The media transport has a configuration with an arced top surface where the arc length of the top surface exceeds the overall width of the transport.

8 Claims, 4 Drawing Sheets

CURVED PRE-FUSER TRANSPORT TO ENABLE LARGER SHEETS THROUGH A XEROGRAPHIC PRINT ENGINE

This invention relates to an electrophotographic or other marking method and system and, more specifically, to a paper or other media-transport mechanism useful in said systems.

BACKGROUND

While the present invention can be used in any media-handling system or marking system, it will be described for the sake of clarity as used in a typical cut-sheet color electrophotographic marking apparatus.

Generally, in commercial electrophotographic marking apparatus (such as copier/duplicators, printers, or the like), a latent-image charge pattern is formed on a uniformly charged photoconductive or dielectric member. Pigmented marking particles (toner) are attracted to the latent-image charge pattern to develop said image on the dielectric member. A receiver member capable of accepting a charge such as paper is then brought into contact with the dielectric member and an electric field is applied to transfer the marking particles (i.e. the developed image) to the receiver member from the dielectric member. Though there are countless potential substrates or "media" that can serve as receiver members in a marking system (e.g. paper, boxboard, polyester, etc), for clarity and simplicity the receiver member will hereafter in this document be referred to as "media." After transfer, the media bearing the transferred image is transported away from the dielectric member; the image is then fixed or fused to the media by heat and/or pressure to form a permanent image thereon. In a typical fusing process where the toner is fused to the media, two rolls are used to form a nip through which the media travels during the fusing process. One roll, usually the harder roll, is a fuser roll, the second roll, usually the softer roll, is the pressure roll.

The media sheet is moved from the transfer station, where the image is transferred from the photoconductor (typically a belt or drum) to the media, and passed to the fuser station where the image is fused to the media. If the media experiences unexpected motion during either the transfer or the fusing process, the image on the media may be disrupted. Sheets that are large enough to extend into in both the fuser and the transfer stations at the same time experience motion effects from both processes and thereby risk image disruption; as such, it is preferred to have the media in only one of those stations at a time. There is generally a fixed distance between the transfer station and the fuser station, thus limiting the length of media that can be used in this type of xerographic system.

It is preferred to have sheets completely out of the transfer station before they enter the fuser station to prevent fuser motion from propagating back through the sheet and impacting the transfer process (and vice versa); therefore, media length is often constrained to be smaller than the distance between those two stations. Previous ideas to accommodate larger sheets required a major print engine architecture overhaul and included repositioning the fuser, creating a separate fusing module, extending the length of the print engine frame, etc. All of these methods would increase the overall machine footprint and have substantial manufacturing cost, tooling, and design resource impacts. Therefore, it is very desirable to have a unit that would extend the media-path length between the transfer station and the fuser station and be easily retrofitted into existing machines.

SUMMARY

This invention provides a curved pre-fuser vacuum transport (PFT) to enable longer sheets within the architectural constraints of the current and future family of print engines. A curved plenum is used to direct a media-transport belt (or belts) in an arc between the image transfer point and the fuser nip. This arc creates a curved media-path that is longer than the straight-line distance between the two subsystems (i.e. transfer station and fuser station), thus enabling longer media to pass through a print engine without the risk of the image disturbances that are related to being simultaneously in both Fusing and Transfer processes.

This curved pre-fuser vacuum transport (PFT) is useful in xerographic apparatus that have space available above the their PFTs (i.e. between transfer and fusing stations). While the PFT of this invention is illustrated for clarity as being used on the same plane as the transfer and fusing stations, it obviously can be used on a different level if suitable. The PFT has a vacuum unit internally that provides, together with apertures on its curved face and in its transport belts, a normal force to hold media sheets to its transport belts and guide the belts, and thus the sheets, through a curved path. The PFT fits between the transfer station and the fuser station and directs sheets in a curved path (rather than in a straight path) between transfer and fuser stations, thus increasing maximum paper size that can be run while still isolating transfer from fuser effects.

The curved PFT allows longer sheets to be used and does not constrain minimum sheet length since all sheets will be vacuum attracted to the belts and directed along the curved path; sheets will be out of the transfer station before entering the fuser station thereby mitigating image disturbances due to simultaneous contact with transfer and fuser stations. All of this is provided at a relatively low cost and can be easily retrofitted into existing or future xerographic apparatus. The media-transport belts used on the curved surface of the PFT are conventional perforated vacuum belts used in present xerographic systems to move media through the various stations. The vacuum can be generated by any suitable vacuum blower such as those in the present PFT system available from Japan Servo, Brushless DC High Performance Blower, part number 127K54210. These vacuum blowers may be driven by any suitable means such as an external motor, batteries or other power sources. Therefore, essential to this invention is the use of a curved plenum to direct a belt (or belts) in an arc between the image transfer point or station and the fuser nip or station. This arc adds distance to the media path between these two stations, thus enabling longer media to be run through the current family of xerographic print engines. An added benefit of the PFT of this invention is that the angles immediately following image transfer and immediately prior to fusing will remain the same as current xerographic family designs and can be easily adjusted for use in future designs.

DETAILED DISCUSSION OF DRAWINGS AND PREFERRED EMBODIMENTS

Figure 1:
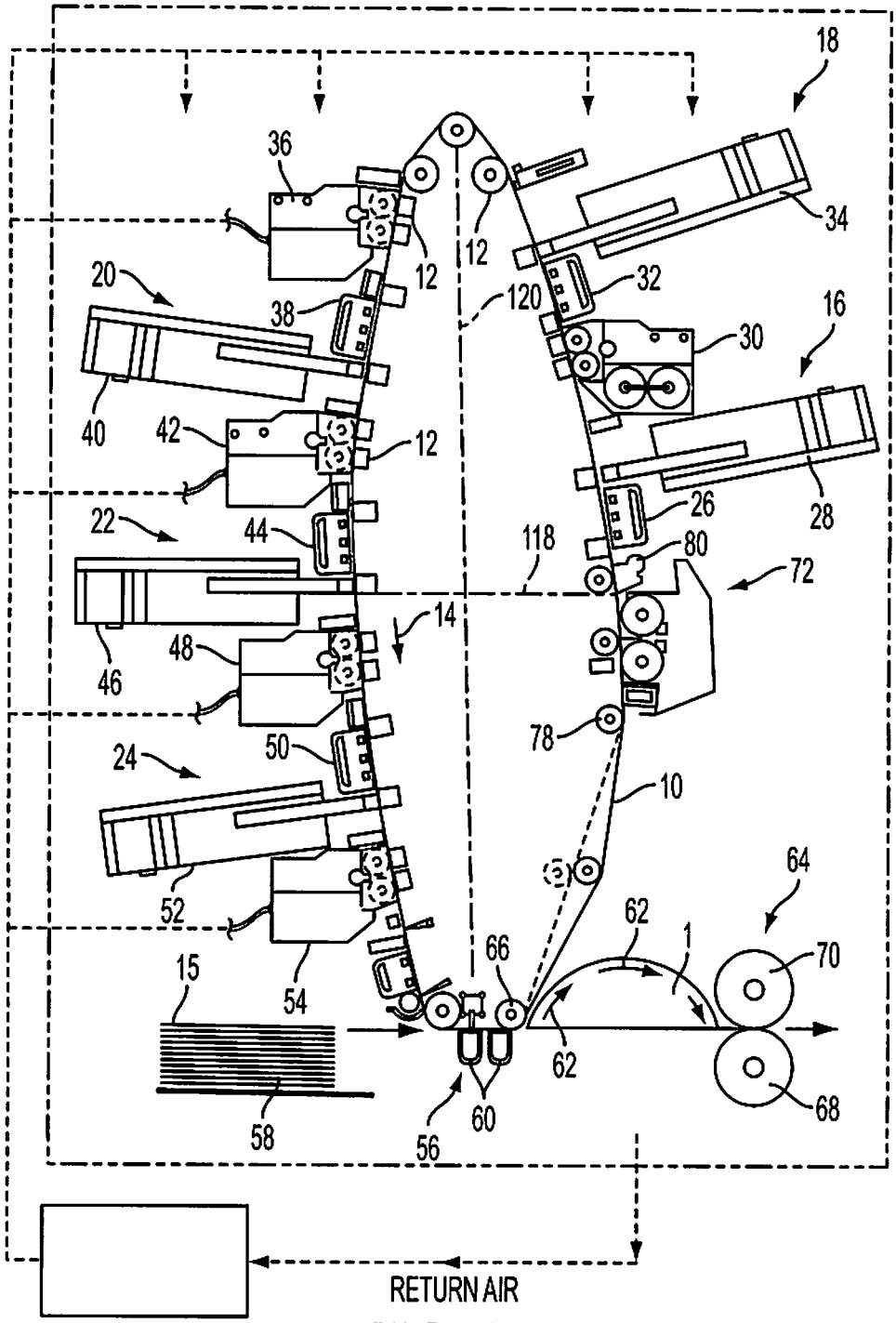
FIG. 1 is a schematic illustration of a color xerographic marking system using an embodiment of the curved pre-fuser vacuum transport (PFT) of this invention. The xerographic system has the "conventional" xerographic color and processing stations, the processing stations comprising a charge station, an exposure station, a developer station, a transfer station, a fusing station, a collection station and a cleaning station. The transport 1 of this invention is configured to be located between the transfer station 56 and the fusing station 64.

In FIG. 1 for clarity, a multi-color xerographic system is illustrated where the PFT 1 of this invention is positioned between the transfer station 56 and the fusing station 64. Inasmuch as the art of electrophotographic printing is well known, the various processing stations employed in the FIG. 1 printing machine will be shown hereinafter schematically and their operation described briefly with reference thereto.

Referring now to the drawings, there is shown a single pass multi-color printing machine in FIG. 1. This printing machine employs the following components: a photoconductive belt 10, supported by a plurality of rollers or bars, 12. Photoconductive belt 10 is arranged in a vertical orientation. Photoconductive belt 10 advances in the direction of arrow 14 to move successive portions of the external surface of photoconductive belt 10 sequentially beneath the various processing stations disposed about the path of movement thereof. The photoconductive belt 10 has a major axis 120 and a minor axis 118. The major and minor axes 120 and 118 are perpendicular to one another. Photoconductive belt 10 is elliptically shaped. The major axis 120 is substantially parallel to the gravitational vector and arranged in a substantially vertical orientation. The minor axis 118 is substantially perpendicular to the gravitational vector and arranged in a substantially horizontal direction. The printing machine architecture includes five image recording stations indicated generally by the reference numerals 16, 18, 20, 22, and 24, respectively. Initially, photoconductive belt 10 passes through image recording station 16. Image recording station 16 includes a charging device and an exposure device. The charging device includes a corona generator 26 that charges the exterior surface of photoconductive belt 10 to a relatively high, substantially uniform potential. After the exterior surface of photoconductive belt 10 is charged, the charged portion thereof advances to the exposure device. The exposure device includes a raster output scanner (ROS) 28, which illuminates the charged portion of the exterior surface of photoconductive belt 10 to record a first electrostatic latent image thereon. Alternatively, a light emitting diode (LED) may be used.

This first electrostatic latent image is developed by developer unit 30. Developer unit 30 deposits toner particles of a selected color on the first electrostatic latent image. After the highlight toner image has been developed on the exterior surface of photoconductive belt 10, photoconductive belt 10 continues to advance in the direction of arrow 14 to image recording station 18.

Image recording station 18 includes a recharging device and an exposure device. The charging device includes a corona generator 32 which recharges the exterior surface of photoconductive belt 10 to a relatively high, substantially uniform potential. The exposure device includes a ROS 34 which illuminates the charged portion of the exterior surface of photoconductive belt 10 selectively to record a second electrostatic latent image thereon. This second electrostatic latent image corresponds to the regions to be developed with magenta toner particles. This second electrostatic latent image is now advanced to the next successive developer unit 36.

Developer unit 36 deposits magenta toner particles on the electrostatic latent image. In this way, a magenta toner powder image is formed on the exterior surface of photoconductive belt 10. After the magenta toner powder image has been developed on the exterior surface of photoconductive belt 10, photoconductive belt 10 continues to advance in the direction of arrow 14 to image recording station 20.

Image recording station 20 includes a charging device and an exposure device. The charging device includes corona generator 38 which recharges the photoconductive surface to a relatively high, substantially uniform potential. The exposure device includes ROS 40 which illuminates the charged portion of the exterior surface of photoconductive belt 10 to selectively dissipate the charge thereon to record a third electrostatic latent image corresponding to the regions to be developed with yellow toner particles. This third electrostatic latent image is now advanced to the next successive developer unit 42.

Developer unit 42 deposits yellow toner particles on the exterior surface of photoconductive belt 10 to form a yellow toner powder image thereon. After the third electrostatic latent image has been developed with yellow toner, photoconductive belt 10 advances in the direction of arrow 14 to the next image recording station 22.

Image recording station 22 includes a charging device and an exposure device. The charging device includes a corona generator 44 which charges the exterior surface of photoconductive belt 10 to a relatively high, substantially uniform potential. The exposure device includes ROS 46 which illuminates the charged portion of the exterior surface of photoconductive belt 10 to selectively dissipate the charge on the exterior surface of photoconductive belt 10 to record a fourth electrostatic latent image for development with cyan toner particles. After the fourth electrostatic latent image is recorded on the exterior surface of photoconductive belt 10, photoconductive belt 10 advances this electrostatic latent image to the cyan developer unit 48.

Developer unit 48 deposits cyan toner particles on the fourth electrostatic latent image. These toner particles may be partially in superimposed registration with the previously formed yellow powder image. After the cyan toner powder image is formed on the exterior surface of photoconductive belt 10, photoconductive belt 10 advances to the next image recording station 24.

Image recording station 24 includes a charging device and an exposure device. The charging device includes corona generator 50 which charges the exterior surface of photoconductive belt 10 to a relatively high, substantially uniform potential. The exposure device includes ROS 52 which illuminates the charged portion of the exterior surface of photoconductive belt 10 to selectively discharge those portions of the charged exterior surface of photoconductive belt 10 which are to be developed with black toner particles. The fifth electrostatic latent image, to be developed with black toner particles is advanced to black developer unit 54.

At black developer unit 54, black toner particles are deposited on the exterior surface of photoconductive belt 10. These black toner particles form a black toner powder image which may be partially or totally in superimposed registration with the previously formed highlight color, yellow, magenta, and cyan toner powder images. In this way, a multi-color toner powder image is formed on the exterior surface of photoconductive belt 10. Thereafter, photoconductive belt 10 advances the multi-color toner powder image to a transfer station indicated generally by the reference numeral 56.

All xerographic subsystems are environmentally maintained inside the xero cavity. Air from and to the xero cavity is conditioned/filtered to predefined set points by using a special design environmental unit.

At transfer station 56, a receiving medium; e.g. paper, is advanced from stack 58 by sheet feeders and guided to transfer station 56. At transfer station 56, a corona generating device 60 sprays ions onto the backside of the paper. This attracts the developed multi-color toner image from the exterior surface of photoconductive belt 10 to the sheet of paper. Stripping assist roller 66 contacts the interior surface of photoconductive belt 10 and provides a sufficiently sharp bend thereat so that the beam strength of the advancing paper is stripped from photoconductive belt 10. A vacuum transport moves the sheet of paper in the direction of arrow 62 to fusing station 64.

Fusing station 64 includes a heated fuser roller 70 and a back-up roller 68. The back-up roller 68 is resiliently urged into engagement with the fuser roller 70 to form a nip through which the sheet of paper passes. In the fusing operation, the toner particles coalesce with one another and bond to the sheet in image configuration, forming a multicolor image thereon. After fusing the finished sheet is discharged to a finishing station where the sheets may be compiled and formed into sets which may be bound to one another.

The paper sheet is fed from media feed 58 and travels until it reaches transfer station 56 where an image is transferred from the p.c. photoconductive belt 10 to the media 15 from stack 58. The media 15 is then fed from the transfer station 56 to the PFT 1 of this invention where it proceeds to the fusing station 64 for fixing the image to the media. The PFT 1 allows an increased travel distance of media between transfer station 56 and fusing station 64 thereby allowing the use of longer media than previously permitted without the PFT 1.

Figure 2:
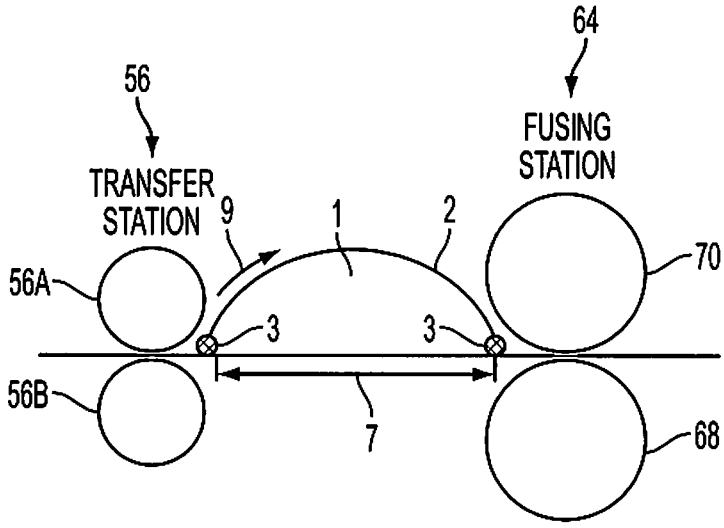
FIG. 2 is a plan view of the transfer and fusing stations of a xerographic marking system where the PFT of the present invention is positioned between said stations.

In FIG. 2, a plan view of an embodiment of the PFT 1 of this invention is illustrated as it is positioned between transfer station 56 and fuser station 64. The distance 7 between a straight line point to point between transfer station 56 and fusing station limits the length of media 15 to the length of distance 7. By placing PFT 1 of this invention on the media path between transfer station 56 and fusing station 64, the use of substantially longer sheets of media 15 is provided. Both the belts 4 and the curved surface 2 of the PFT 1 have vacuum apertures therein that will expose the media 15 to the vacuum, drawing the media down onto the belts 4, allowing the belts 4 to hold and transport the sheets of media 15 to the fusing station 64. Previously, media 15 beyond a certain length would be simultaneously caught in the transfer station 56 (i.e. statically adhered to the photoreceptor) and the rollers 68 and 70 of fusing station 64 which could distort the images being transferred or fused.

Figure 3:
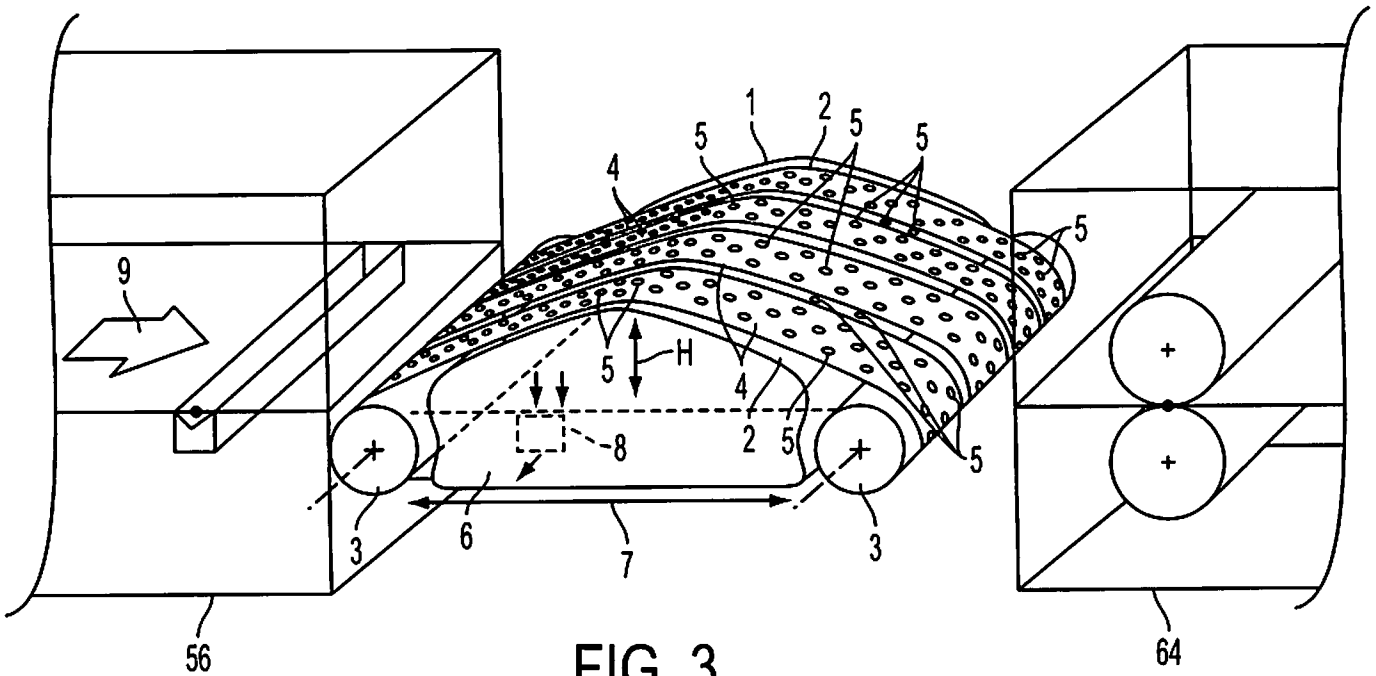
FIG. 3 is a perspective view of an embodiment of the PFT of this invention.

In FIG. 3, a perspective view of the PFT 1 of this invention is illustrated as it is positioned between transfer station 56 and fuser station 64. Belts 4 are movably positioned around curved surface 2 of the PFT 1 and around drive rollers 3. The PFT 1 is hermetically sealed by manifold cover 6 so that the vacuum generated by blower 8 will be effective. Blower 8 generates the vacuum that is conveyed through vacuum apertures 5 that allow the media sheet 15 to adhere to the belts 4 that ride along the curved surface 2. Increasing H allows longer sheets to fit in between transfer and fuser thereby increasing maximum media size that can be run while still isolating transfer from fuser effects. The vacuum blower 8 is shown in dotted lines since it is internal of the hermetically-sealed housing 7. This blower 8 generates the negative air pressure that creates the vacuum through apertures 5. The pre-fuser transport 1 of this invention has a top substantially arc-like rounded section 2 over which movable belts 4 travel. The belts 4 are moved by at least one drive roller 3 which is located at a bottom substantially flat section of the transport 1. The top rounded section 2 has apertures therein (as do the belts 4) that provide the vacuum to hold media sheets onto the rounded section 2. A vacuum blower 8 is positioned internal of the transport 1 to provide the vacuum effect that is transmitted through the apertures. In order for the blower 8 to be effective, the frame 6 of the transport 1 must be closed or sealed. Any suitable number of belts 4 may be used depending on the desired transport effect. The transport 1 may be on the same or different horizontal plane as are the transfer station 56 and the fuser station 64. They are shown in the figures as all being on the same plane; this is done for the sake of clarity.

Figure 4:
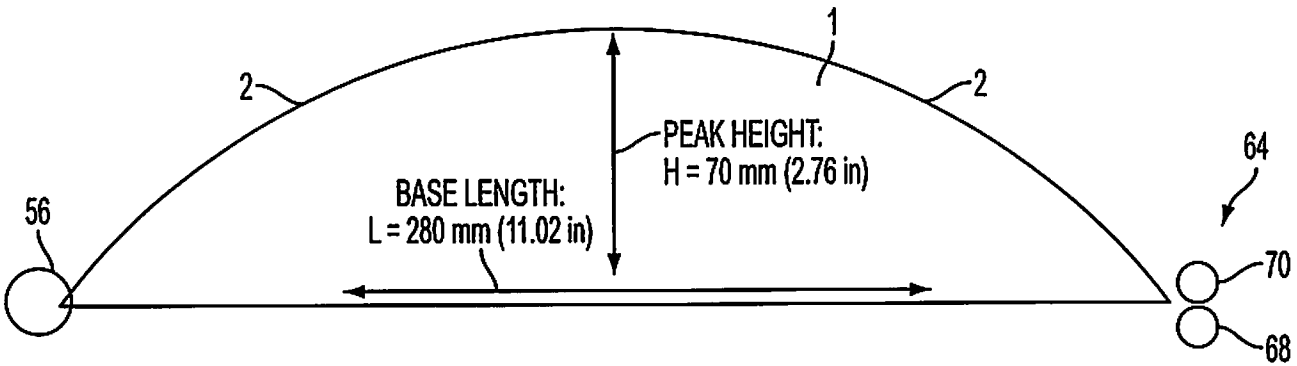
FIG. 4 is a plan view of an embodiment of a PFT of this invention with specific numerical designations of this example illustrated.

A specific example to illustrate the present invention (not limit) is illustrated and set out in this description of FIG. 4. In this example, PFT 1N and PFT 3N have a combined length of 327.5 mm (12.89 in). The profile of PFT 2N (FIG. 4) will be an arc 2 with a radius of 175 mm. This profile design results in a total arc 2 length of 324.55 mm (12.78 in) which increases the total media-path length between image transfer and fusing to 652.1 mm (25.67 in). This lengthens the current maximum sheet length in this area of the print engine by 44.6 mm (1.75 in).

These parameters (H and L) could be optimized within current architecture to accommodate the maximum possible sheet length. Parameters H and L could also be optimized to minimize cost (e.g. create 3 identical PFT's; the second PFT would be assembled with a curved plenum and different belt size). Furthermore, the radius of the arc 2 shall be optimized to prevent the disturbance of unfused toner while the sheet 15 travels along the arc. If a more extensive redesign was desired, it may be possible to reduce the vertical space constraints immediately after transfer and immediately before fusing. This would allow the arc of the curved transport 1 to extend over a wider span and further increase the maximum allowed sheet size through this area of the media path.

This (or similar) design could be implemented in a current press with roll feed and third party finishing equipment (current feeders of this family of machines and stackers to not accommodate sheets larger than 22.5 in). There would be potential to redesign the stacker top tray and side catch tray (within the current frame restraints) to accommodate media with process length greater than 22.5 inches.

In summary, this invention provides a xerographic marking system comprising the conventional xerographic stations including a transfer station and an adjoining fusing station. Positioned between the transfer station and the fuser station is a pre-fuser media transport. This transport is configured to increase a distance the media must travel between the transfer station and the fuser station. This media transport comprises a structure having a substantially arc-like top section and a substantially flat bottom section.

At least one movable belt is positioned on the top section and is configured to move across the top section to transport at least one media sheet from the transfer station to the fuser station.

At least one drive roller is provided on the pre-fuser transport to supply movement to the movable belt or belts. This drive roller or rollers is positioned between the top portion and the bottom section.

A vacuum blower is provided internally of the pre-fuser media transport. This vacuum blower is configured to apply a vacuum through apertures in the top section. The vacuum thereby is configured to hold paper or other such media against the belt (or belts) during transporting of the media. This media transport comprises a hermetically-sealed housing over which the movable belt or belts travel. The housing has a vacuum blower internally therein and in communication with the air outlet vacuum apertures. The pre-fuser transport has preferably from two to four movable belts which are used (more can be used if suitable); these belts have vacuum apertures therein. This pre-fuser transport is configured to permit long sheets to be transported from the transfer station to the fuser station.

In an embodiment, the media sheet is configured to be positioned between the xerographic transfer station and a xerographic fusing station. This sheet transport comprises a hermetically-sealed housing. The housing has a substantially arc-like rounded top section and a substantially flat bottom section.

A blower vacuum is positioned internally of the housing and provides a vacuum effect that will exit through apertures through the top section. This vacuum is configured to hold a media sheet or sheets against movable belts positioned over the top section during a media transport step. This media sheet transport is configured to lengthen a travel distance of the media sheet between the transfer station and the fuser station. The media sheet transport has movable belts that are constructed of flexible rubber materials or any other suitable materials. The pre-fuser media sheet transport of this invention is configured to be retrofitted into suitable existing xerographic marking apparatus.

It will be appreciated that variations of the above-disclosed and other features and functions, or alternatives thereof, may be desirably combined into many other present or future different marking systems or applications. Various presently unforeseen or unanticipated alternatives, modifications, variations, or improvements therein may be subsequently made by those skilled in the art which are also intended to be encompassed by the following claims.

What is claimed is:

1. A xerographic marking system comprising:

a transfer station;

an adjoining fusing station; and a pre-fuser media transport positioned between the transfer station and the fusing station, the pre-fuser media transport comprising a structure having an arched top section and a substantially flat bottom section, the arched top section of the pre-fuser media transport being configured to increase a travel distance of a media sheet between the transfer station and the adjoining fusing station by 1.75 inches or more compared to if the top section was flat, and at least one movable belt being configured to move across the top section to transport the media sheet from the transfer station to the fusing station.

2. The xerographic marking system of claim 1, at least one drive roller being provided to supply movement to the at least one movable belt, the drive roller being positioned between the arched top section and the flat bottom section.

3. The xerographic marking system of claim 1, further comprising a vacuum blower located internally to the pre-fuser media transport, the vacuum blower being configured to apply a vacuum through apertures in the top section to hold the media sheet on the at least one movable belt.

4. The xerographic marking system of claim 1, the pre-fuser media transport being configured to permit long sheets to be transported from the transfer station to the fusing station without causing image disturbances resulting from the media sheet being simultaneously nipped in both the transfer and fusing stations.

5. An image forming device comprising:

a transfer station;

an adjoining fusing station; and a media sheet transport positioned between the transfer station and the fusing station, the media sheet transport comprising:

a housing having a substantially arc-like rounded top section and a substantially flat bottom section, and a blower vacuum positioned internally in the housing, the blower vacuum being configured to apply a vacuum through the top section of the housing via apertures in the top section of the housing, the vacuum holding a media sheet against movable belts positioned over the top section of the housing for transport of the media sheet, and the substantially arc-like rounded top section of the housing being configured to lengthen a travel distance of the media sheet between the transfer station and the fusing station by 1.75 inches or more compared to if the top section was flat.

6. The image forming device of claim 5, at least one drive roller being provided to supply movement to the movable belts.

7. The image forming device of claim 5, the movable belts being moved by at least one drive roller and at least one idler roller or surface.

8. The image forming device of claim 5, the movable belts being constructed of flexible rubber materials.

* * * * *